US009584887B2

(12) United States Patent
Spillmann et al.

(10) Patent No.: US 9,584,887 B2
(45) Date of Patent: Feb. 28, 2017

(54) RIGGING SYSTEM LOCKING MECHANISM

(71) Applicant: HARMAN INTERNATIONAL INDUSTRIES, INC., Stamford, CT (US)

(72) Inventors: Jacques Spillmann, Los Angeles, CA (US); Lawrence Romestant, Northbridge, CA (US)

(73) Assignee: Harman International Industries, Inc., Stamford, CT (US)

( * ) Notice: Subject to any disclaimer, the term of this patent is extended or adjusted under 35 U.S.C. 154(b) by 34 days.

(21) Appl. No.: 14/597,900

(22) Filed: Jan. 15, 2015

(65) Prior Publication Data

US 2015/0208150 A1 Jul. 23, 2015

Related U.S. Application Data

(60) Provisional application No. 61/928,879, filed on Jan. 17, 2014.

(51) Int. Cl.

| | |
|---|---|
| ***H04R 25/00*** | (2006.01) |
| ***H04R 1/02*** | (2006.01) |
| ***H04R 1/32*** | (2006.01) |
| ***H04R 1/40*** | (2006.01) |

(52) U.S. Cl.

CPC ..... *H04R 1/02* (2013.01); *H04R 1/026* (2013.01); *H04R 1/323* (2013.01); *H04R 1/403* (2013.01); *H04R 2201/025* (2013.01)

(58) Field of Classification Search

USPC ..... 381/182

See application file for complete search history.

(56) References Cited

U.S. PATENT DOCUMENTS

| | | | | |
|---|---|---|---|---|
| 6,536,842 | B2 * | 3/2003 | Bowers et al. | 297/344.22 |
| 6,640,924 | B2 | 11/2003 | Messner | |
| 7,298,860 | B2 | 11/2007 | Engebretson et al. | |
| 7,328,769 | B1 * | 2/2008 | Adamson | H04R 1/026 181/144 |
| 8,170,263 | B2 | 5/2012 | Engebretson et al. | |
| 2014/0205132 | A1 | 7/2014 | Spillmann et al. | |

FOREIGN PATENT DOCUMENTS

EP 2787745 A1 10/2014

OTHER PUBLICATIONS

SPEK-TRIX User Manual version 1.0, Adamson Systems Engineering, Copyright, 2009.

Nexo S.A.—GEO T Series User Manual V1.05, May 10, 2010.

Extended European Search Report for corresponding EP Application No. 15151128.4, dated Jun. 3, 2015, 5 pages.

* cited by examiner

*Primary Examiner* — Amir Etesam

(74) *Attorney, Agent, or Firm* — Brooks Kushman P.C.

(57) ABSTRACT

A speaker rigging system is provided with a frame, a cam pivotally connected to the frame about a pivot axis and a sector secured to the cam with a peripheral surface with a plurality of teeth formed therein. The speaker rigging system also includes a lever arm and a pawl. The lever arm is pivotally connected to the frame with a proximal end and an intermediate portion extending between the proximal end and the pivotal connection to be oriented proximate to the sector. The pawl extends from the intermediate portion of the lever arm and is spring-biased toward the sector for engaging one of the plurality of teeth to lock the cam to the frame in a locked condition.

19 Claims, 7 Drawing Sheets

RIGGING SYSTEM LOCKING MECHANISM

CROSS-REFERENCE TO RELATED APPLICATIONS

This application claims the benefit of U.S. provisional application Ser. No. 61/928,879 filed Jan. 17, 2014, the disclosure of which is hereby incorporated in its entirety by reference herein.

TECHNICAL FIELD

One or more embodiments relates to a locking mechanism for a rigging system for a line array of speakers.

BACKGROUND

A line array of speakers is a group of often similarly sized speakers positioned adjacent to one another to optimize a sound level output over a larger coverage area. Line array speaker systems are often used in large venues, such as auditoriums and concert halls, where high sound level is projected over a wide coverage area. Line array speakers provide increased directivity at various frequencies. Providing increased directivity at various frequencies extends the near-field coverage area because the coverage distance from the near field to the far field transition zone is increased with frequency. The ability of line array speaker systems to increase near field extension is known. For this reason, line arrays offer significant advantages over traditional multi-box sound systems and are often used for large venues.

To achieve a desired sound level over a desired coverage area, line arrays are strategically positioned in various places, at varying heights and angles, throughout a venue. The positioning of the line arrays is determined using equations that anticipate the performance of differently sized speakers based upon their arrangement relative to one another. The specific height of a line array, and the angle and spacing between the speakers in the line array are the main variables that govern the sound level output and coverage area of the line array. The height of an array governs the line array's directivity. The spacing of the individual speakers, which is a second-order effect, determines a lobing structure of the line array. For example, a relatively straight array may radiate the sound level desired for far field coverage. For near field coverage, the line arrays often require some degree of curvature to provide uniformity of coverage over a wider vertical angle.

Once a speaker arrangement for a given venue is determined, the speakers in the line arrays are then typically arranged and mounted on specially designed racks. Depending upon the desired arrangement, the line arrays are then suspended in the air with hanging equipment, which is referred to as a "tension" configuration herein and/or placed on the ground, which is referred to as a "compression" configuration herein. Additionally, support structure (e.g., chains) may be connected to speakers that are hung from the ceiling, such that the corresponding rigging systems are in compression. By arranging the line array speakers and articulating or curving the line array in the vertical plane at a specific splay angle, one can provide excellent coverage for listeners seated in both the near and the far fields.

U.S. Pat. No. 8,170,263 to Engebretson et al. discloses an example of a rigging system for line array speakers and allows for the adjustment of a splay angle between adjacent loudspeakers.

SUMMARY

In one embodiment, a speaker rigging system is provided with a frame, a cam pivotally connected to the frame about a pivot axis and a sector secured to the cam with a peripheral surface with a plurality of teeth formed therein. The speaker rigging system also includes a lever arm and a pawl. The lever arm is pivotally connected to the frame with a proximal end and an intermediate portion extending between the proximal end and the pivotal connection to be oriented proximate to the sector. The pawl extends from the intermediate portion of the lever arm and is spring-biased toward the sector for engaging one of the plurality of teeth to lock the cam to the frame in a locked condition.

In another embodiment, a speaker rigging system is provided with a frame and a cam pivotally connected to the frame about a pivot axis to pivot relative to the frame for adjusting a splay angle. The speaker rigging system also includes a first lever arm and a second lever arm. The first lever arm includes a proximal end, a first portion pivotally connected to the frame and an intermediate portion extending between the proximal end and the first portion, the intermediate portion being spring-biased toward the pivot axis and adapted to engage the cam for locking the cam to the frame in a locked condition. The second lever arm is pivotally connected to the frame with a proximal end that is spring-biased toward the pivot axis to engage the first lever arm for maintaining the locked condition.

In yet another embodiment, a speaker array is provided with a first speaker assembly and a second speaker assembly. The first speaker assembly includes a first speaker cabinet with laterally spaced apart first side surfaces and a first frame mounted to one of the first side surfaces. The first speaker assembly also includes a first cam pivotally connected to the first frame about a first pivot axis and a first link with a first proximal end pivotally connected to the first frame and a first distal end with a first contact surface formed therein. The second speaker assembly includes a second speaker cabinet with laterally spaced apart second side surfaces and a second frame mounted to one of the second side surfaces. The second speaker assembly also includes a second cam, a sector and a second link. The second cam is pivotally connected to the second frame about a second pivot axis, wherein the second cam has at least two steps formed into a peripheral surface, each step being formed with an independent cam surface that is offset at a different radial distance from the second pivot axis corresponding to a splay angle. The sector is secured to the second cam and centered about the second pivot axis with a plurality of teeth formed into a peripheral surface and spaced apart from each other. The second link includes a second proximal end pivotally connected to the second frame and a second distal end with a second contact surface formed therein. The first link extends from the first frame in a deployed position such that the first contact surface engages one of the steps of the second cam of the second speaker assembly for orientating the first speaker assembly and the second speaker assembly at a splay angle therebetween corresponding to the step. The second speaker assembly also includes a lever arm and a pawl. The lever arm includes a proximal end, a central portion pivotally connected to the second frame and an intermediate portion extending between the proximal end and the central portion, the intermediate portion being oriented proximate to the sector. The pawl is formed on the intermediate portion of the lever arm. The pawl is spring-biased toward the sector for engaging one of the plurality of teeth for locking the cam to the second frame in a locked condition and maintaining the splay angle between the first speaker assembly and the second speaker assembly.

DETAILED DESCRIPTION

As required, detailed embodiments of the present disclosure are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
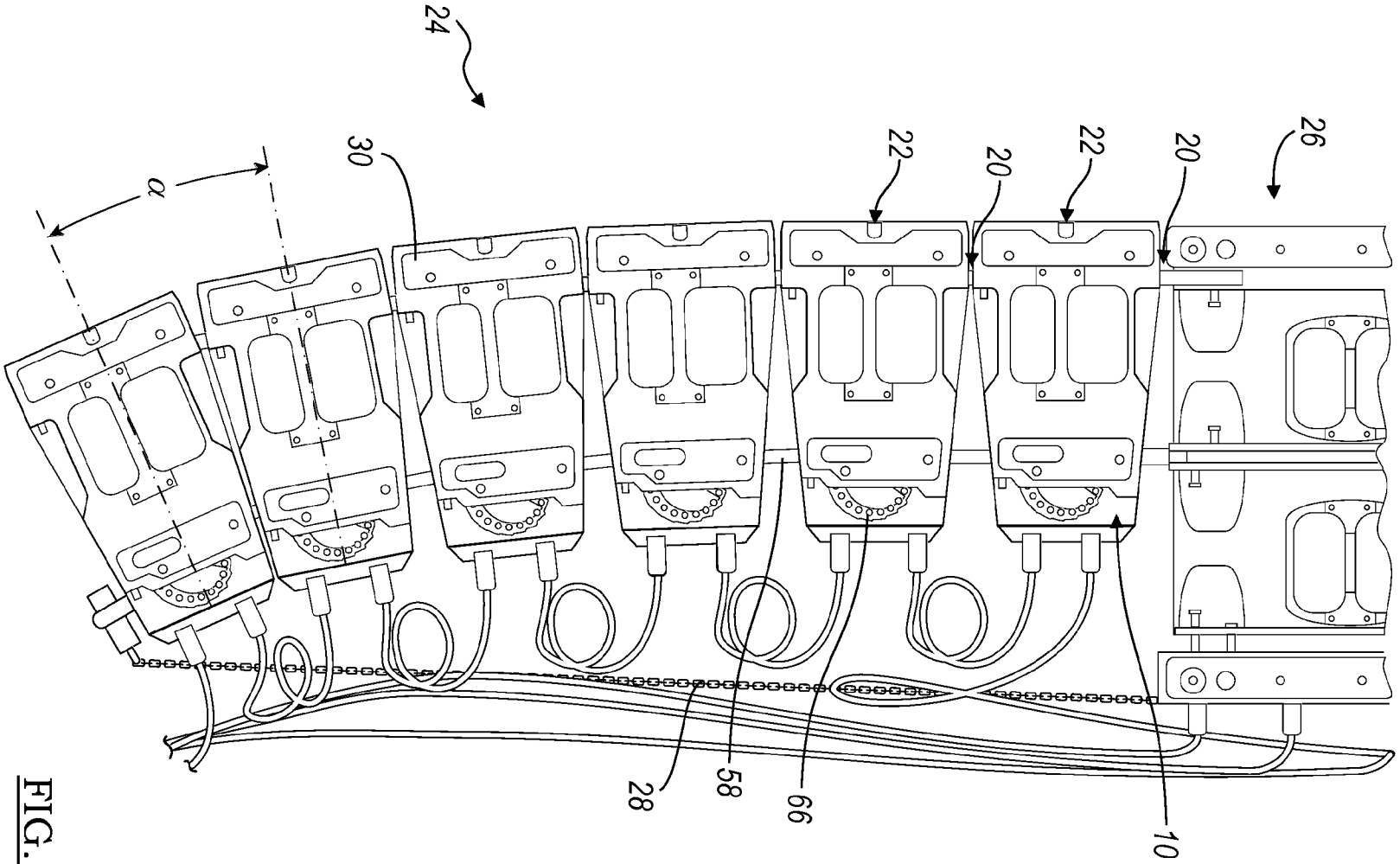
FIG. 1 is a right side perspective view of a line array of speaker assemblies that are orientated in a compression configuration.

With reference to FIG. 1, a locking mechanism for a rigging system is illustrated in accordance with one or more embodiments and is generally represented by numeral 10. A rigging system 20 is mounted to each speaker assembly 22. The rigging system 20 is used to connect a speaker assembly 22 to a vertically adjacent speaker assembly 22 to form a line array 24 of speaker assemblies 22. The illustrated embodiment depicts the line array 24 suspended and in a compression configuration. The uppermost speaker assembly 22 is connected to a base 26, and additional support structure 28 (e.g., chains) connects the base 26 to a lowermost speaker assembly 22, such that the rigging systems 20 are in compression. As described in U.S. Patent Application Ser. No. 61/754,167, the splay angles are maintained by a fastener (e.g., a pin) when the speaker assemblies 22 are oriented in a tension configuration, and by compressive forces (without a fastener) when oriented in a compression configuration.

The rigging system 20 allows for the adjustment of a vertical splay angle between adjacent speaker assemblies 22. As shown in FIG. 1, the splay angle (not shown) between the two uppermost speaker assemblies 22 is approximately zero°, and the splay angle (a) between the two lowermost speaker assemblies 22 is approximately 12.5°. The splay angles of a line array 24 are typically selected, by adjusting the rigging system 20, before the line array 24 is suspended or "flown". Each rigging system 20 includes the locking mechanism 10 to maintain the selected splay angle while the speaker assemblies 22 are hoisted or "flown" into position.

The illustrated embodiment depicts a line array 24 of six speaker assemblies 22. However, other embodiments contemplate line arrays 24 of more than six or less than four speaker assemblies. The number of speaker assemblies 22 in a line array 24 depends on the sound requirements of a venue, the weight of each speaker assembly 22 and the load capacity of each rigging system 20. Each speaker assembly 22 includes a pair of covers 30 that are each disposed over one of the rigging systems 20.

Figure 2:
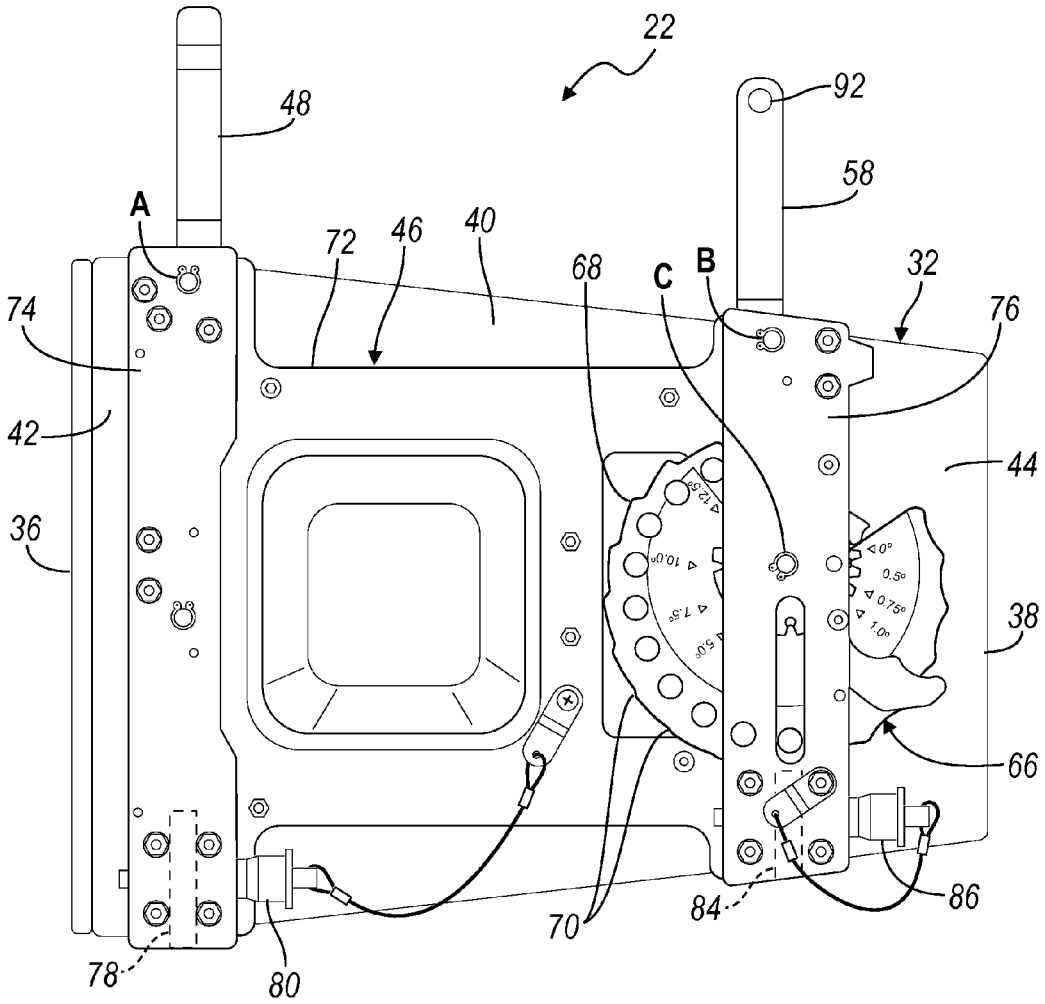
FIG. 2 is an enlarged right side view of a speaker assembly of FIG. 1, illustrated without a cover and with a rigging system having a locking mechanism according to one or more embodiments.

FIG. 2 illustrates a speaker assembly 22 without the cover 30 (shown in FIG. 1). Each speaker assembly 22 includes a cabinet 32 with a front surface 36, a rear surface 38 and a pair of side surfaces 40 extending between the front and rear surfaces 36, 38. In one embodiment, the cabinet has a front surface 36 with a vertical height of approximately 11 in. (280 mm), a lateral width of approximately 35.5 in. (900 mm), and a side surface 40 with a longitudinal length of approximately 15.8 in. (400 mm). Each speaker assembly weighs approximately 90 lbs (41 kg). Other embodiments of the speaker assembly contemplate different sizes.

Each side surface 40 includes a front end 42 that is adjacent to the front surface 36, and a rear end 44 that is adjacent to the rear surface 38. The front end 42 has a greater vertical height than the rear end 44 such that each side surface 40 is formed in a generally trapezoidal shape. The rigging system 20 includes a frame 46 that is mounted to a side surface 40 of the speaker assembly 22.

The rigging system 20 includes a front link 48 that is pivotally connected to an upper portion of a front end 42 of the frame 46. The front link 48 pivots about axis "A" between a stowed position (not shown) and a deployed position. The rigging system 20 also includes a rear link 58 that is pivotally connected to an upper portion of a rear end 44 of the frame 46. The rear link 58 pivots about axis "B" between a stowed position (not shown) and a deployed position. The front link 48 and the rear link 58 each extend upward from the frame 46 when oriented in the deployed positions to connect to a lower portion of the frame 46 of a vertically adjacent cabinet (shown in FIG. 1).

The rigging system 20 includes a cam 66 for adjusting a splay angle between two vertically adjacent speaker assemblies 22. The cam 66 is pivotally connected to an intermediate portion of the frame 46. The cam 66 pivots about axis "C". The cam 66 has a peripheral surface 68 with a series of steps 70 formed therein. Each step 70 is formed as an independent cam surface and offset at a different radial distance from axis C. Each step 70 is separated from an adjacent step 70 by an intermediate surface, and corresponds to a different splay angle of the speaker assembly 22. A step 70 of the cam 66 engages a rear link 58 of a lower speaker assembly (shown in FIG. 1) for setting a splay angle between the speaker assemblies 22 corresponding to the step 70.

The frame 46 includes an inner plate 72 and outer plates that are laterally spaced apart from each other. The outer plates include a front outer plate 74 and a rear outer plate 76. The inner plate 72 is mounted to a side surface 40 of the speaker cabinet 32. The frame 46 includes a plurality of blocks (not shown) that are mounted between the inner plate 72 and the outer plates 74, 76 for maintaining the lateral spacing. Some blocks include longitudinally extending apertures for receiving fasteners.

A series of blocks (not shown) are mounted between a lower portion of the front outer plate 74 and the inner plate 72 and oriented to form a front vertically extending channel 78 for receiving the front link 48 of a lower speaker assembly when it is oriented in the deployed position, as shown in FIG. 1. At least two of the blocks include apertures for receiving a front pin 80. The front pin 80 may be connected to the frame 46 by a cable, as shown in the illustrated embodiment. The front link 48 includes a longitudinally extending aperture (not shown) that aligns with the apertures of the blocks for receiving the pin 80 and connecting the front ends of two adjacent speaker assemblies 22 together (as shown in FIG. 1). As illustrated in FIG. 2, the front pin 80 may also be stored within the blocks when it is not being used to connect the speaker assemblies 22.

A series of blocks (not shown) are also mounted between a lower portion of the rear outer plate 76 and the inner plate 72 and oriented to form a rear vertically extending channel 84 for receiving the rear link 58 of a lower speaker assembly when it is oriented in the deployed position, as shown in FIG. 1. At least two of the blocks include apertures for receiving a rear pin 86. The rear pin 86 may be connected to the frame 46 by a cable, as shown in the illustrated embodiment. The rear link 58 includes a slot (not shown) that aligns with the apertures of the blocks for receiving the rear pin 86 and connecting the rear ends of the two adjacent speaker assemblies 22 together, as shown in FIG. 1. As illustrated in FIG. 2, the rear pin 86 may also be stored within the blocks when it is not being used to connect the speaker assemblies 22.

Figure 3:
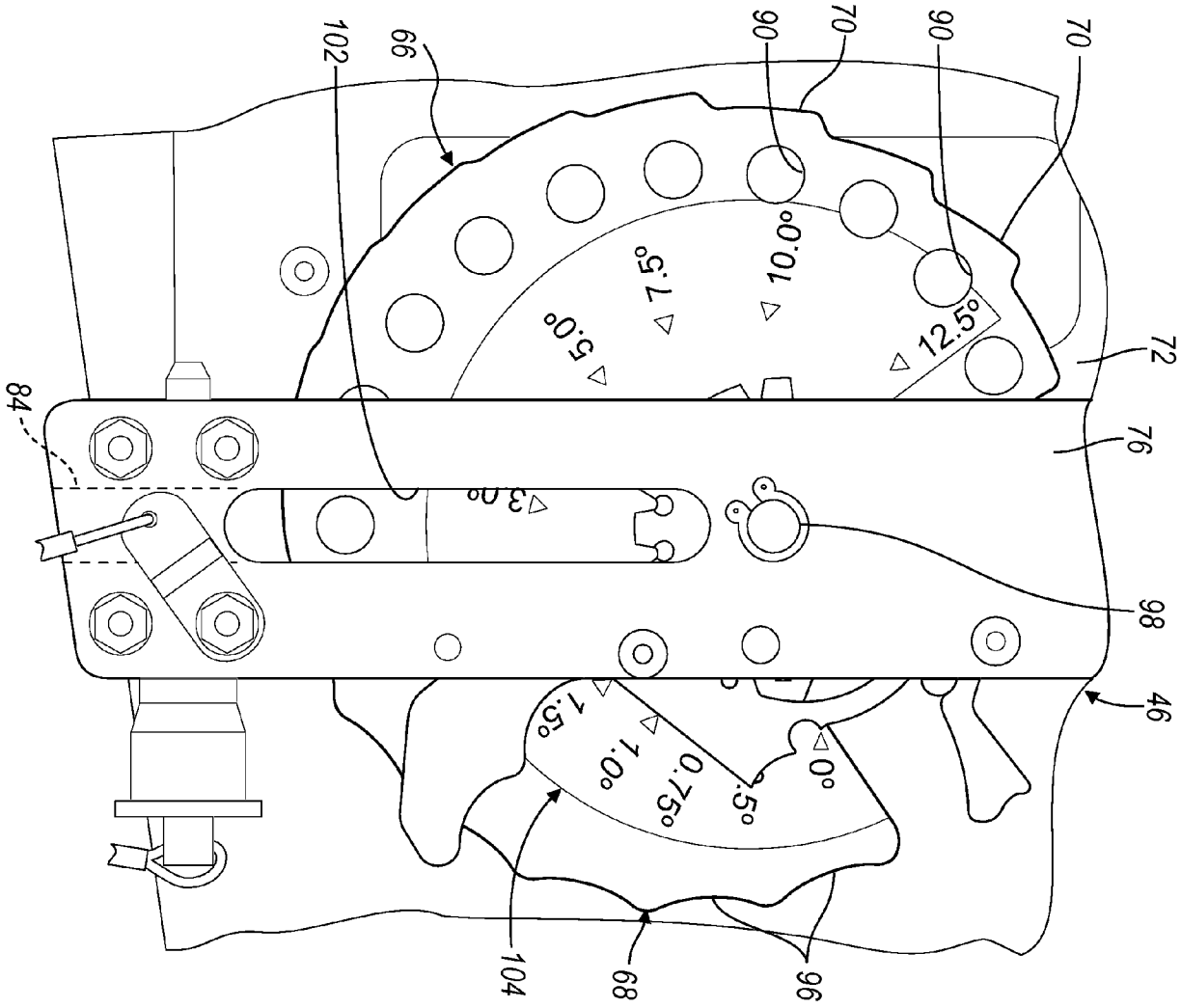
FIG. 3 is an enlarged partial view of the rigging system of FIG. 2, illustrating the locking mechanism in a locked condition.

With reference to FIG. 3, the cam 66 includes a series of apertures 90 that angularly align with the series of steps 70 such that a cam aperture 90 is oriented radially inward of each step 70. Each rear link 58 includes an aperture 92 (shown in FIG. 2) that projects laterally through a distal end. The rear link aperture 92 aligns with one of the cam apertures 90, for receiving a lock pin 94 and connecting the rear link 58 to the cam 66 of a vertically adjacent speaker assembly 22 to lock a splay angle (as shown in FIG. 1).

The cam 66 provides a large splay angle range in a compact package, as compared to existing adjustment mechanisms that include shafts with a plurality of holes that correspond to different splay angles. Additionally, the cam 66 allows for small angle increments (e.g., 0.25°).

The cam 66 operates as a handle for manually adjusting the splay angle, according to one or more embodiments. A plurality of indentations 96 that are formed into a portion of the peripheral surface 68 that is beyond the steps 70. In one embodiment, the maximum diameter of the cam 66 is between 13 and 14 cm which is sized such that a user having an average size hand can grip opposing sides of the cam 66. The rigging system 20 includes a shaft 98 that extends through the inner plate 72 and the rear outer plate 76. The shaft 98 is aligned along axis C and rotates relative to the frame 46. The cam 66 is secured to the shaft 98, and the user rotates the cam 66 about axis C to adjust the splay angle.

By rotating the cam 66, a user may select a splay angle between the speaker assembly 22 and an adjacent speaker assembly 22 (shown in FIG. 1). Each step 70 on the cam 66 is offset from Axis C by a different radial distance, which corresponds to a different splay angle. The cam 66 of the illustrated embodiment provides an adjustable splay angle range of between 0° and 12.5°. The frame 46 includes a slot 102 which extends vertically upward from the channel 84. To adjust the cam 66 to a specific splay angle, a user rotates the cam 66 until the step 70 associated with the desired splay angle is oriented within the slot 102.

With reference to FIG. 3, the rigging system 20 includes a visual interface for assisting the user in selecting a desired splay angle, according to one or more embodiments. In one embodiment, the visual interface includes indicia 104 indicative of the splay angle range. The indicia 104 is disposed on an outer surface of the cam 66 and angularly spaced about Axis C, such each splay angle is oriented approximately ninety degrees offset from the corresponding step 70. For example, the cam 66 illustrated in FIG. 3 is oriented such that the step 70 associated with the 0° splay angle is oriented within the slot 102, and the value "0°" is oriented approximately ninety degrees offset from the step 70.

Figure 4:
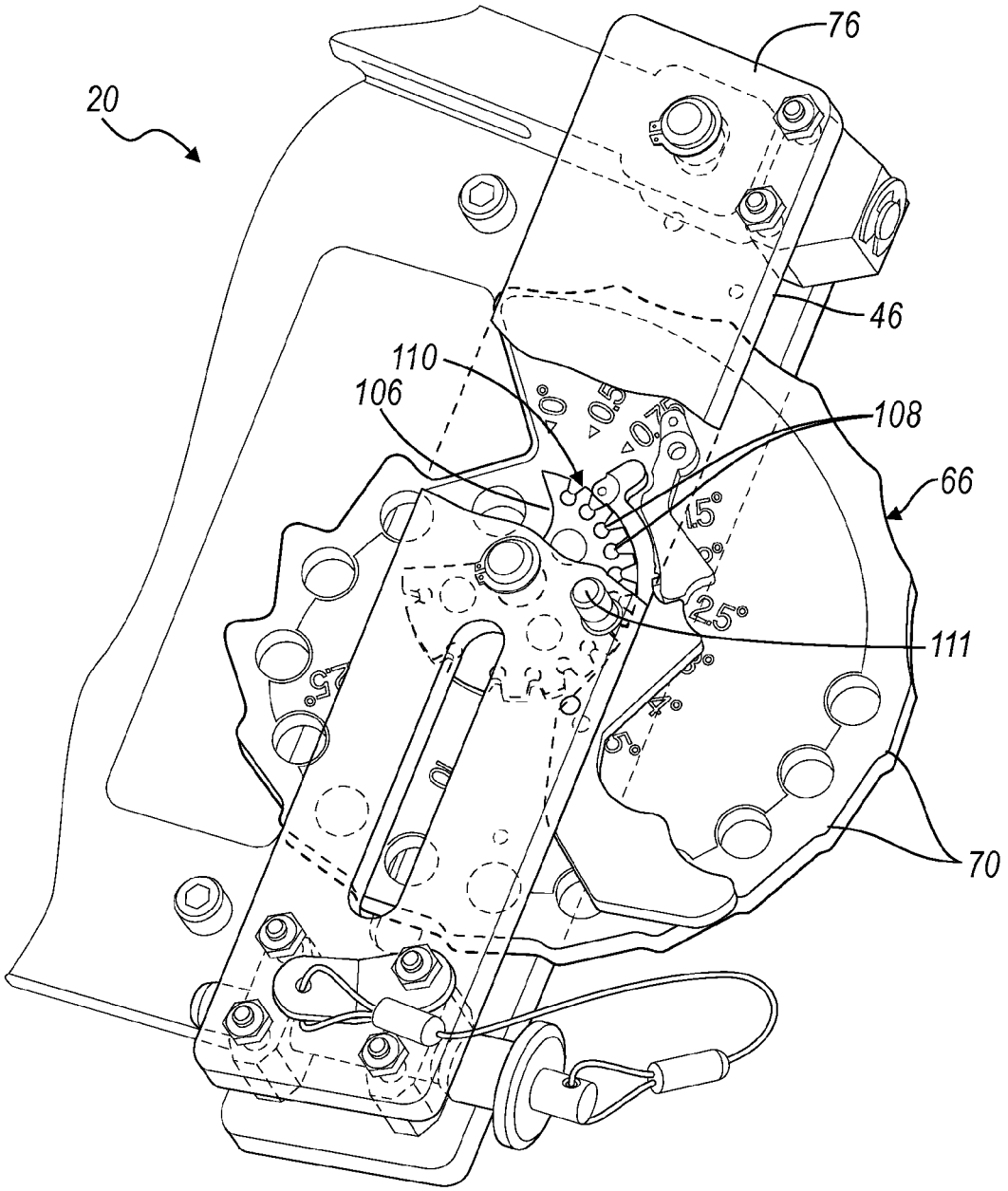
FIG. 4 is an enlarged side perspective view of the rigging system of FIG. 2, illustrating the locking mechanism oriented in a locked condition.

Referring to FIG. 4, the rigging system 20 includes a feedback mechanism for providing tactile feedback to a user during indexing of the cam 66 between the splay angles. The rigging system 20 includes a sector 106 that is secured to the cam 66. A radial array of detents 108 are formed into an outer surface of the sector 106. The rear outer plate 76 is shown partially fragmented in FIG. 4 to illustrate the detents 108. The detents 108 are spaced corresponding to the steps 70 of the cam 66. A plurality of teeth 110 are formed into a peripheral surface of the sector 106. In the illustrated embodiment, each detent 108 is disposed radially inward of a root between adjacent teeth 110. A ball plunger 111 is secured to the rear outer plate 76 and spring-biased to engage the detents 108 as the cam 66 is rotated to provide positive tactile feedback.

When the speaker assemblies are oriented in the compression configuration (as shown in FIG. 1), the cam 66 and the rear link 58 are coupled to each other without a fastener, because they are subjected to compressive loads due to the weight of the upper speaker assembly 22.

Figure 5:
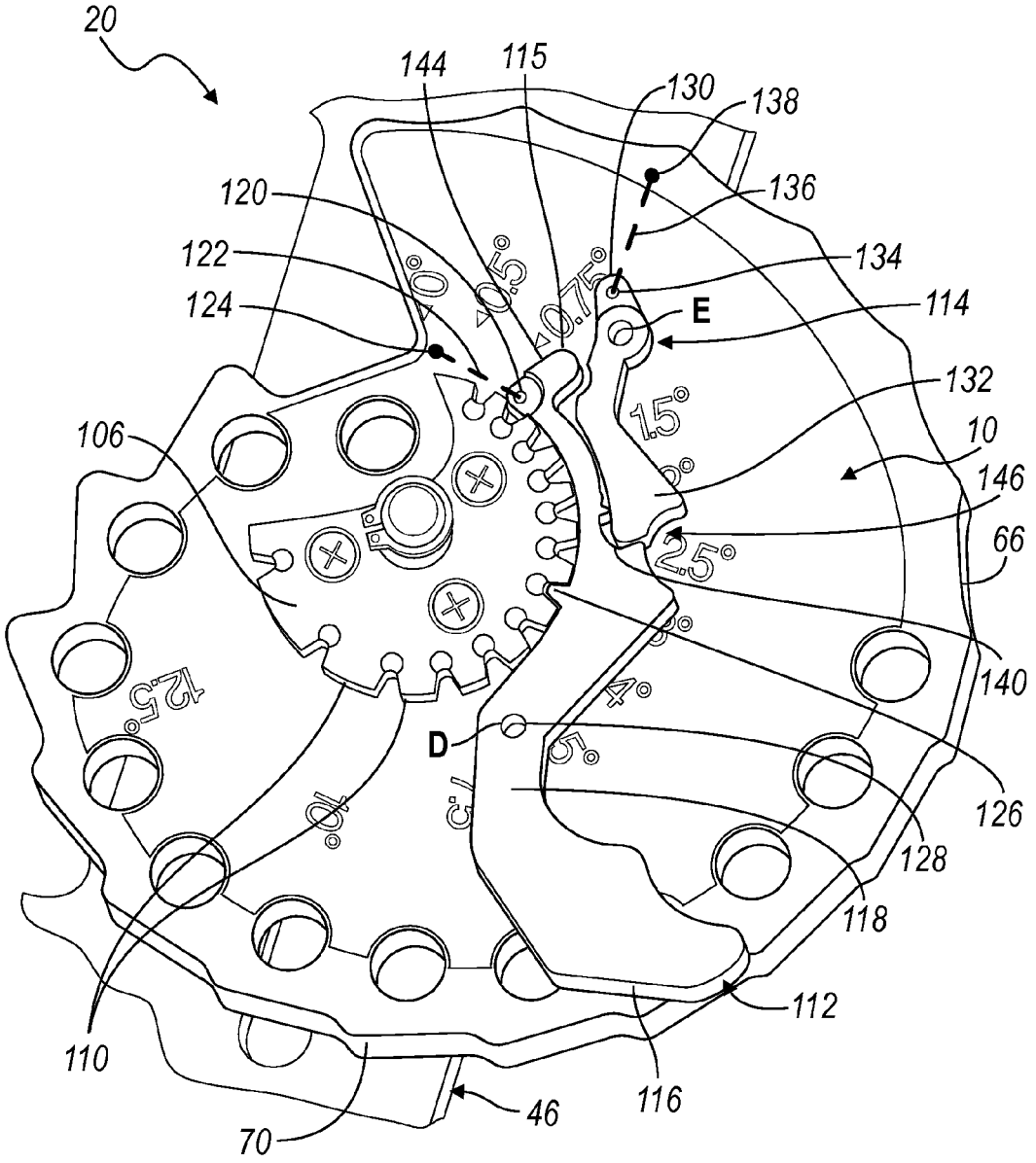
FIG. 5 is an enlarged partial side perspective view of the rigging system of FIG. 2, illustrating the locking mechanism oriented in the locked condition.

With reference to FIG. 5, each rigging system 20 includes the locking mechanism 10 to maintain the selected splay angle while the speaker assemblies 22 are hoisted or "flown" into position. The locking mechanism 10 includes an indexing lever arm 112 and a flag lever arm 114.

The indexing lever arm 112 is adapted to lock the cam 66 to the frame 46. The indexing lever arm 112 is pivotally connected to the rear outer plate 76 about axis D, and disposed between the rear outer plate 76 (shown in FIG. 4) and the cam 66. The indexing lever arm 112 includes a proximal end 115, a distal end 116 and a central portion 118. The proximal end 115 includes an aperture 120 formed therethrough that is sized for receiving a leg of a tension spring 122. An opposite end of the tension spring 122 is secured to a pin 124 that extends through the rear outer plate 76. An intermediate portion of the indexing lever arm 112 is contoured to generally circumscribe the sector teeth 110. The indexing lever arm 112 includes a pawl 126 that extends radially inward from the intermediate portion to engage the sector 106 between the teeth 110. The proximal end 115 is biased toward the sector 106 by the tension spring 122, such that the pawl 126 engages the sector 106 between adjacent teeth 110 for locking the cam 66 to the frame 46. The central portion 118 includes an aperture 128 formed therethrough that is aligned with axis D, and sized for receiving a pin that extends through the rear outer plate 76 (shown in FIG. 4). The indexing lever arm 112 is fixed to the pin for pivoting about axis D. The distal end 116 extends radially outward relative to axis D.

The flag lever arm 114 is adapted to lock the indexing lever arm 112 in a locked condition, as shown in FIG. 5. The flag lever arm 114 is pivotally connected to the rear outer plate 76 about axis E, and disposed between the rear outer plate 76 (shown in FIG. 4) and the cam 66. The flag lever arm 114 includes a distal end 130 and a proximal end 132. The distal end 130 includes an aperture 134 formed therethrough that is sized for receiving a leg of a tension spring 136. An opposite end of the tension spring 136 is secured to a pin 138 that extends through the rear outer plate 76. An outer surface of the indexing lever arm 112 is contoured to form a pocket 140. The pocket 140 is sized for receiving an inner portion of the proximal end 132 of the flag lever arm 114. The distal end 130 of the flag lever arm 114 is biased away from the sector 106 by the tension spring 136, such that the proximal end 132 engages the indexing lever arm 112 within the pocket 140 for locking the indexing lever arm 112 in the locked condition, as shown in FIG. 5.

Figure 6:
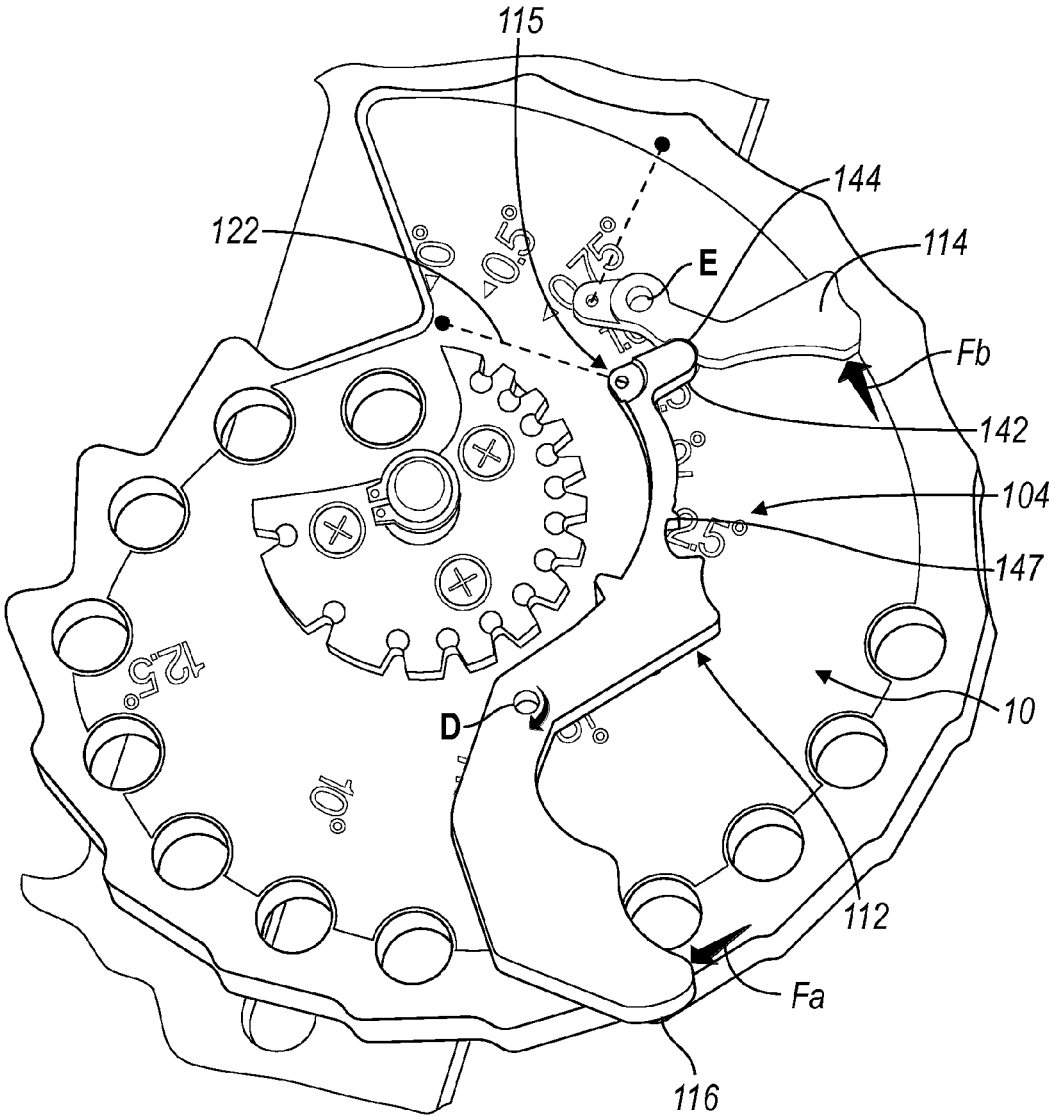
FIG. 6 is another enlarged partial side perspective view of the rigging system of FIG. 2, illustrating the locking mechanism oriented in an unlocked condition.

With reference to FIG. 6, a user may unlock the locking mechanism 10 by applying a downward force (Fa) to the distal end 116 of the indexing lever arm 112. A projection 142 extends outward from the proximal end 115 of the indexing lever arm 112. A recess 144 is formed into an inner surface of the flag lever arm 114. By applying the downward force (Fa) to the distal end 116, the indexing lever arm 112 pivots clockwise about axis D, as shown in FIG. 6. During such pivotal motion, the projection 142 contacts the flag lever arm 114 and pivots the flag lever arm 114 counter clockwise about axis E, as shown in FIG. 6. Once the projection 142 engages the recess 144, the pivotal motion of both lever arms 112, 114 stops; and the locking mechanism 10 is held stationary in an unlocked condition, as shown in FIG. 6.

The locking mechanism 10 is released by applying an upward force (Fb) to the flag lever arm 114. By applying force Fb, the flag lever arm 114 rotates further counter clockwise about axis E, which releases the indexing lever arm 112 from engagement with the recess 144, and the indexing lever arm 112 returns to the locked condition (shown in FIG. 5) due to the spring force of tension spring 122.

With reference to FIGS. 5 and 6, the locking mechanism 10 includes a pointer feature that coordinates with the visual interface to indicate the selected splay angle. The proximal end 132 of the flag lever arm 114 and the central portion 118 of the indexing lever arm 112 are contoured to collectively form an opening 146 around the selected splay angle indicia 104 when the locking mechanism 10 is oriented in the locked condition. As shown in FIG. 5, the opening 146 is formed around splay angle 2.5°, when the step 70 corresponding to 2.5° is selected. With reference to FIG. 6, a projection 147 extends radially outward from the indexing lever arm 112, and is aligned with the selected splay angle indicia 104, when the locking mechanism 10 is oriented in the unlocked condition.

Figure 7:
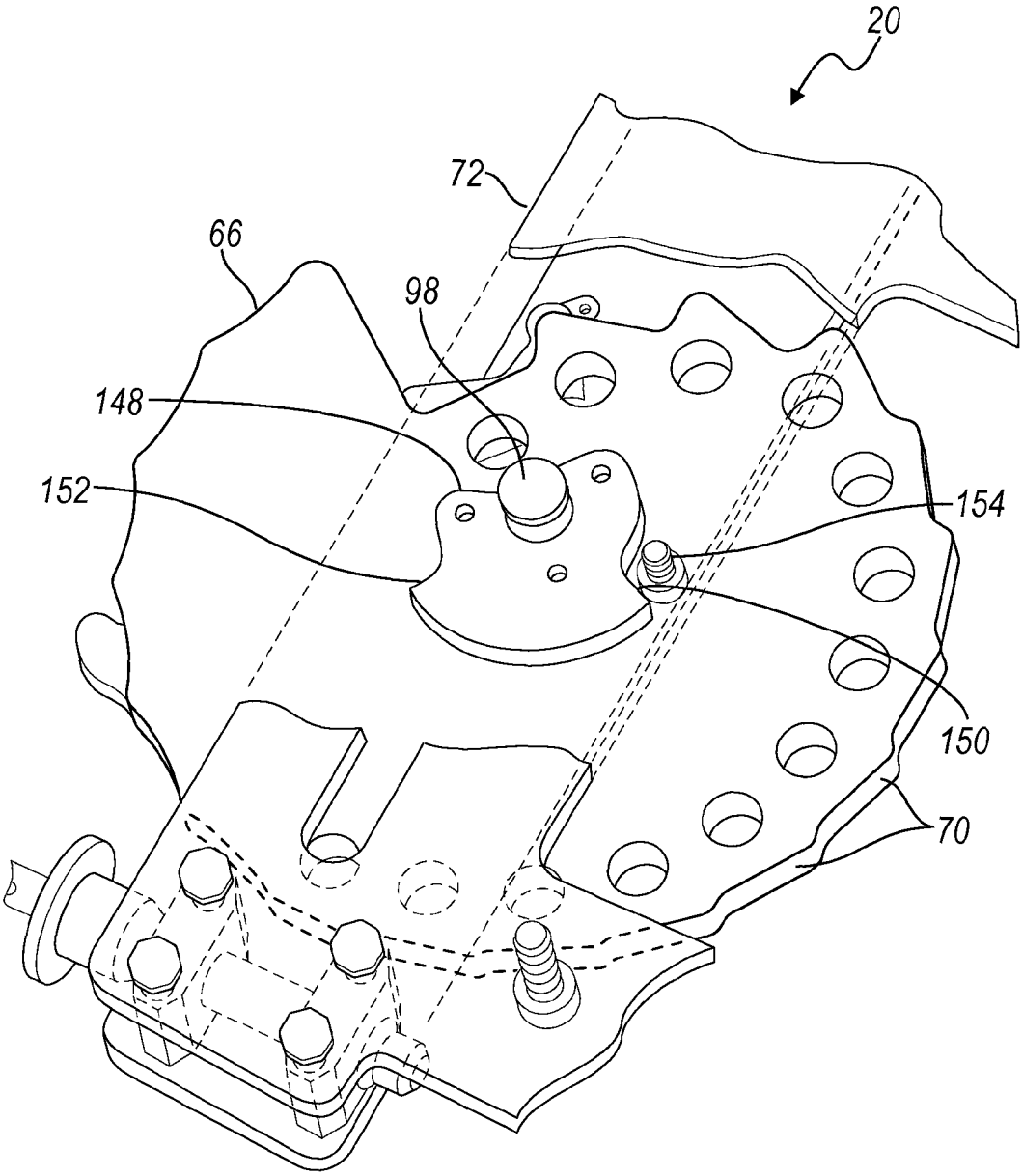
FIG. 7 is an enlarged left side view of the rigging system of FIG. 2, illustrating an end stop mechanism.

Referring to FIG. 7, the rigging system 20 includes a hub 148 that limits the angular travel of the cam 66, according to one or more embodiments. The hub 148 is disposed between the cam 66 and the inner plate 72. The hub 148 is secured to a rear surface of the cam 66 about the shaft 98. The hub 148 is contoured to provide an end stop 150 that corresponds to a minimum splay angle (e.g., 0°), and an end stop 152 that corresponds to a maximum splay angle (e.g., 12.5°). A pin or fastener 154 is secured to inner plate and contacts each end stop 150, 152 at the corresponding angular travel limit of the cam. For example, as shown in FIG. 7, the cam 66 is adjusted such that the step 70 corresponding to the minimum splay angle (0°) is selected, and the minimum end stop 150 is contacting the pin 154 to limit further angular adjustment.

Thus, the rigging system 20 provides a cam 66 having a series of steps 70 formed as independent cam surfaces, where each step corresponds to a different splay angle. Such a cam 66 provides a large splay angle range in a compact package, and allows for small splay angle increments (e.g., 0.25°). When used in a compression configuration, the steps 70 engage a corresponding shoulder formed in the rear link 58 for distributing the weight of the speaker assemblies 22 over a large bearing surface without a fastener. Further, the locking mechanism 10 allows a user to selectively lock the selected splay angle of the rigging system 20, so that the angle is not inadvertently adjusted while assembly and flying of the loudspeakers.

In one or more embodiments, a speaker rigging system is provided with a locking mechanism. The speaker rigging system includes a frame and a cam. The frame includes a first plate and a second plate that is laterally spaced apart from the first plate. The first plate is adapted to mount to a side surface of a speaker cabinet. The cam is pivotally connected to the frame about a pivot axis and disposed between the first plate and the second plate, and includes with at least two cam surfaces. The locking mechanism includes a sector, an indexing lever arm and a flag lever arm. The sector is secured to the cam and centered about the pivot axis. The sector includes a plurality of teeth that are formed into a peripheral surface and spaced apart from each other. The indexing lever arm is pivotally connected to the second plate and disposed between the second plate and the cam. The indexing lever arm includes a pawl that is formed into an inner surface. The indexing lever arm is spring-biased toward the sector for engaging one of the teeth, and locking the cam to the frame. The flag lever arm is also pivotally connected to the second plate and disposed between the second plate and the cam. The flag lever arm is spring-biased such that a proximal end of the flag lever arm engages the lever for maintaining the locked condition.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A speaker rigging system comprising:

a frame;

a cam pivotally connected to the frame about a pivot axis;

a sector secured to the cam with a peripheral surface with a plurality of teeth formed therein;

a lever arm pivotally connected to the frame with a proximal end and an intermediate portion extending between the proximal end and the pivotal connection to be oriented proximate to the sector;

a pawl extending from the intermediate portion of the lever arm and spring-biased toward the sector for engaging one of the plurality of teeth to lock the cam to the frame in a locked condition; and a second lever arm pivotally connected to the frame with a proximal end that is spring-biased toward the sector to engage the lever arm for maintaining the locked condition.

2. The speaker rigging system of claim 1 wherein the lever arm further comprises a distal end extending from the pivotal connection to pivot away from the sector to an unlocked condition in which the sector is disengaged from the tooth in response to a transverse force applied to the distal end.

3. The speaker rigging system of claim 2 further comprising a second lever arm pivotally connected to the frame with an intermediate portion with a recess formed therein that is adapted to receive and retain a projection extending outward from the proximal end of the lever arm for retaining the lever arm in the unlocked condition.

4. The speaker rigging system of claim 1 wherein the frame comprises:

a first plate; and a second plate laterally spaced apart from the first plate, the first plate being adapted to mount to a side surface of a speaker cabinet, wherein the cam is disposed between the first plate and the second plate, and wherein the lever arm is pivotally connected to the second plate and disposed between the second plate and the cam.

5. The speaker rigging system of claim 4 further comprising:

a hub secured to cam about the pivot axis and disposed between the cam and the first plate; and a pin extending transversely from the first plate to engage the hub when the cam is adjusted to a maximum splay angle for limiting angular adjustment.

6. The speaker rigging system of claim 1 further comprising:

indicia indicative of a range of splay angle values associated with the cam; and a projection extending from an outer surface of the lever arm to align with one of the splay angle values when the lever arm is oriented in an unlocked condition.

7. The speaker rigging system of claim 1 wherein the cam further comprises at least two cam surfaces, each of the at least two cam surfaces being offset at a different radial distance from the pivot axis corresponding to a splay angle for selective adjustment of the splay angle when the lever arm is unlocked condition.

8. The speaker rigging system of claim 7 wherein the cam further comprises an extended peripheral surface oriented angularly offset from the at least two cam surfaces with a plurality of indentations formed therein to provide a handle for manual adjustment of the splay angle.

9. A speaker rigging system comprising:

a frame;

a cam pivotally connected to the frame about a pivot axis to pivot relative to the frame for adjusting a splay angle;

a first lever arm with a proximal end, a first portion pivotally connected to the frame and an intermediate portion extending between the proximal end and the first portion, the intermediate portion being spring-biased toward the pivot axis and adapted to engage the cam for locking the cam to the frame in a locked condition; and a second lever arm pivotally connected to the frame with a proximal end that is spring-biased toward the pivot axis to engage the first lever arm for maintaining the locked condition.

10. The speaker rigging system of claim 9 further comprising:

a sector secured to the cam and centered about the pivot axis with a plurality of teeth formed into a peripheral surface and spaced apart from each other; and a pawl formed on the intermediate portion of the first lever arm, the pawl being spring-biased toward the sector for engaging one of the teeth for locking the cam to the frame in the locked condition.

11. The speaker rigging system of claim 9 wherein the first lever arm further comprises a distal end extending outward and away from the first portion, and wherein the first lever arm is adapted to pivot away from the pivot axis to an unlocked condition in response to a force being applied to the distal end in a first direction.

12. The speaker rigging system of claim 9 wherein the second lever arm further comprises an intermediate portion with a recess formed therein that is adapted to receive and retain a projection extending outward from the proximal end of the first lever arm for retaining the first lever arm in an unlocked condition.

13. The speaker rigging system of claim 9 wherein the cam further comprises at least two cam surfaces, each of the at least two cam surfaces being offset at a different radial distance from the pivot axis corresponding to a splay angle and wherein the cam is adapted to pivot about the pivot axis for selective adjustment of the splay angle when the first lever arm is oriented in an unlocked condition.

14. The speaker rigging system of claim 13 further comprising:

indicia indicative of a range of splay angle values associated with the at least two cam surfaces disposed on the cam; and a projection extending from an outer surface of the first lever arm and adapted to align with one of the splay angle values when the first lever arm is oriented in the unlocked condition.

15. A speaker array comprising:

a first speaker rigging system according to claim 13; and a second speaker rigging system according to claim 13, the second speaker rigging system further comprising a link with a proximal end pivotally connected to the frame and a distal end with a contact surface, wherein the link extends from the frame in a deployed position to engage a cam surface of the cam of the first speaker rigging system, wherein the splay angle comprises an angle between a first longitudinal axis that bisects the frame of the first speaker rigging system and a second longitudinal axis that bisects the frame of the second speaker rigging system.

16. A speaker array comprising:

a first speaker assembly with a first speaker cabinet with laterally spaced apart first side surfaces;

a first frame mounted to one of the first side surfaces;

a first cam pivotally connected to the first frame about a first pivot axis;

a first link with a first proximal end pivotally connected to the first frame and a first distal end with a first contact surface formed therein;

a second speaker assembly with a second speaker cabinet with laterally spaced apart second side surfaces;

a second frame mounted to one of the second side surfaces;

a second cam pivotally connected to the second frame about a second pivot axis, wherein the second cam has at least two steps formed into a peripheral surface, each step being formed with an independent cam surface that is offset at a different radial distance from the second pivot axis corresponding to a splay angle;

a sector secured to the second cam and centered about the second pivot axis with a plurality of teeth formed into a peripheral surface and spaced apart from each other;

a second link with a second proximal end pivotally connected to the second frame and a second distal end with a second contact surface formed therein;

wherein the first link extends from the first frame in a deployed position such that the first contact surface engages one of the steps of the second cam of the second speaker assembly for orientating the first speaker assembly and the second speaker assembly at a splay angle therebetween corresponding to the step;

a lever arm with a proximal end, a central portion pivotally connected to the second frame and an intermediate portion extending between the proximal end and the central portion, the intermediate portion being oriented proximate to the sector; and a pawl formed on the intermediate portion of the lever arm, the pawl being spring-biased toward the sector for engaging one of the plurality of teeth for locking the cam to the second frame in a locked condition and maintaining the splay angle between the first speaker assembly and the second speaker assembly.

17. The speaker array of claim 16 further comprising a second lever arm pivotally connected to the second frame with a proximal end that is spring-biased toward the sector to engage the lever arm for maintaining the locked condition.

18. The speaker array of claim 16 wherein the lever arm further comprises a distal end extending outward and away from the central portion, and wherein the lever arm is adapted to pivot away from the sector to an unlocked condition in which the sector is disengaged from the tooth in response to a transverse force being applied to the distal end in a first direction.

19. The speaker array of claim 16 further comprising:

indicia indicative of a range of splay angle values associated with the at least two steps disposed on the cam; and a projection extending from an outer surface of the lever arm and adapted to align with one of the splay angle values when the lever arm is oriented in an unlocked condition.

* * * * *